United States Patent [19]

Birdy et al.

[11] Patent Number: 4,655,642

[45] **Date of Patent: * Apr. 7, 1987**

[54] ARCTIC STRUCTURE OF COMPOSITE WALL CONSTRUCTION

[75] Inventors: Jal N. Birdy; Brian J. Watt; Jade Chen, all of Houston, Tex.

[73] Assignee: Brian Watt Associates, Inc., Houston, Tex.

[ * ] Notice: The portion of the term of this patent subsequent to Aug. 27, 2002 has been disclaimed.

[21] Appl. No.: 697,239

[22] Filed: Feb. 1, 1985

Related U.S. Application Data

[63] Continuation-in-part of Ser. No. 563,940, Dec. 28, 1983, Pat. No. 4,537,532.

[51] Int. Cl.[4] ..... E02D 23/00; E02D 31/00; E04B 5/04

[52] U.S. Cl. ..... 405/217; 405/211; 52/600; 249/10

[58] Field of Search ..... 405/61, 195, 203–205, 405/211, 212, 216, 217; 52/333, 334, 378, 383, 598, 600; 249/4, 10, 13, 33, 36, 38, 40, 42, 117, 129, 135; 264/31, 35

[56] References Cited

U.S. PATENT DOCUMENTS

| | | | |
|---|---|---|---|
| 1,159,184 | 11/1915 | Dale | 249/33 X |
| 1,758,606 | 5/1930 | Jacobs | 405/222 |
| 1,830,397 | 11/1931 | Kleitz | 249/38 |
| 2,902,743 | 9/1959 | King | 249/10 |
| 3,348,382 | 10/1967 | Blenkam et al. | 405/211 |
| 3,385,015 | 5/1968 | Hadley | 52/234 X |
| 3,952,527 | 4/1976 | Vinieratos et al. | 405/217 |
| 4,044,522 | 8/1977 | Sturmer et al. | 52/333 X |
| 4,245,929 | 1/1981 | Pearce et al. | 405/217 X |
| 4,321,779 | 3/1982 | Kratchmer | 52/425 |
| 4,325,655 | 4/1982 | Jahns et al. | 405/61 X |
| 4,427,320 | 1/1984 | Bhula | 405/217 |
| 4,486,125 | 12/1984 | Reusswig | 405/203 X |
| 4,537,532 | 8/1985 | Chen et al. | 405/217 |

*Primary Examiner*—Cornelius J. Husar
*Assistant Examiner*—Nancy J. Stodola
*Attorney, Agent, or Firm*—Pravel, Gambrell, Hewitt & Kimball

[57] ABSTRACT

A structure having a polygonal base and sloping sides forming a frustrum includes a load bearing outer skin which contains an inner assembly and an outer assembly. Both the inner and outer assemblies include a skin plate member which is stiffened by stiffeners welded to one side of the skin plate member. The stiffeners are located at spaced intervals from each other and are disposed substantially perpendicular to the skin plate member. The inner and outer assembly are placed substantially parallel to each other to form a composite structure having an internal cavity defined by the inner and outer plates. The stiffeners of the inner assembly and the outer assembly are disposed in the cavity at a spaced relation to each other and extend partly into the cavity. A cementitious material substantially fills the cavity thereby completing the load bearing outer skin structure. The stiffeners may be flat steel plates or may have the profile of structural shapes such as angles or T's among others.

29 Claims, 10 Drawing Figures

ARCTIC STRUCTURE OF COMPOSITE WALL CONSTRUCTION

This application is a continuation in part application of copending application Ser. No. 563,940, filed Dec. 28, 1983 now U.S. Pat. No. 4,537,532 entitled "Composite Load Bearing Outer Skin for an Arctic Structure and a Method for Erecting Same".

BACKGROUND OF THE INVENTION

The present invention relates to marine structures having load bearing outer skins which are suitable to support a platform for carrying out operations in arctic and sub-arctic regions. Such marine structures are particularly well suited for conducting exploration and drilling in areas such as the Alaskan Beufort Sea and serve equally well for such operations as supporting production equipment, liquefaction plants, gas compression plants, crude oil storage and offshore loading facilities in this and other such regions.

Since in most arctic and sub-arctic locations, only about two months of acceptable weather for construction per year are available, structures employing a load bearing outer skin should ideally require a minimum amount of construction effort at the job site. Structures adapted for use in ice laden environments typically employ load bearing outer skins designed to safely resist substantial ice forces encountered when such structures are installed in an offshore location. Structures designed for offshore use in arctic environments have to withstand highly concentrated local loads from first year and multi-year ice features. Typical designs for load bearing outer skins of such structures include heavily reinforced or stiffened skin plate members for resisting local loads caused by ice formations. In the alternative, such load bearing outer skins may be formed from high strength, heavily reinforced and prestressed concrete or similar materials.

Since such offshore structures used in exploration in arctic areas must be relocated from one drilling site to another in the event a first drilling site proves unsuccessful, the overall structure needs to be light enough to be able to be floated from one location to the next with a very shallow draft.

Similarly, due to the short period available for construction in arctic or sub-arctic regions, construction techniques for building a load bearing outer skin must be simple, thereby permitting quick assembly.

DESCRIPTION OF THE PRIOR ART

In the past, load bearinq outer skins for offshore arctic marine structures have been made from reinforced concrete or similar cementitious materials. A concrete load bearing outer skin required the use of costly high strength yet lightweight concrete. Furthermore, in order to achieve sufficient rigidity to resist point loads from adjacent ice formations, the concrete had to be highly reinforced and prestressed to achieve the required strength. Since flexural reinforcement, such as reinforcement bars, could not be placed at the most advantageous position near the top and bottom of the concrete surfaces, such structures were inherently inefficient. Since the forms used for pouring concrete load bearing outer skins were so congested with reinforcement in order to withstand local ice loads, workmen frequently experienced difficulty in placing and adequately vibrating the concrete to remove air voids.

Vibrating the concrete was necessary not only to remove air voids within the slab but to insure the concrete was sufficiently compacted around all the reinforcement bars. Furthermore, since a concrete load bearing outer skin required structurally substantial top and bottom forms in order to support the fresh concrete, workmen frequently experienced difficulties in removing the forms from the inside of the structure once the concrete had set. Finally, although ice-bond reducing coatings have been successfully applied to metallic surfaces, such coatings have yet to be successfully applied to concrete surfaces. Accordingly, prior art concrete load bearing outer skins for offshore structures in arctic environments were typically too heavy, too expensive and too difficult to assemble.

Other designs for load bearing outer skins for arctic offshore structures used various types of steel construction. One design featured a load bearing outer skin comprising an assembly of thick steel skin plates welded together. The thick steel skin plates were stiffened by T-shaped structural members connected to the underside of the thick steel skin plates to transmit ice loads to the underlying structure. The T-shaped main stiffeners were generally disposed at spaced intervals parallel to each other and welded to the inside surface of those thick steel skin plates which were to contact the ice formations. The outer skin was further stiffened by a series of secondary structural stiffeners disposed at spaced intervals parallel to each other and perpendicular to the main stiffeners. The secondary stiffeners were typically welded between the main stiffeners. The main stiffeners were continuously welded to the thick steel skin plates.

These load bearing outer skins employing a stiffened steel design suffered from several drawbacks. In order to withstand local ice loads the steel plates spanning the stiffeners had to be relatively thick and heavy thereby increasing the weight of the overall structure. A considerable amount of labor was required to cut and weld the thick steel plates as well as the structural reinforcing members. Local loads applied by ice formations to the outer skin were transferred directly and virtually without dispersal to the supporting members through the main stiffeners. Accordingly, the main stiffeners had to be sufficiently rigid to resist high local loads. Accidental impact from multi-year ice features could damage or distort the outer skin plates and the underlying stiffeners.

Another design for a load bearing outer skin for an arctic offshore structure has been to use an inner and an outer thick steel skin plate joined together by a number of steel web plates continuously welded at each end to the inner and outer thick steel skin plates. In some applications cavity formed between the inner and outer thick steel skin plates was filled with ooncrete or some other cementitious material. The problem with this type of design for a load bearing outer skin was that the continuous welds necessary to form the structure had to be made in a confined space. Similarly, inspection and rectification of defective welds was also impeded due to the confined quarters between the inner and outer steel skin plates during fabrication.

SUMMARY OF THE INVENTION

The present invention provides an economical structure featuring a lightweight load bearing outer skin for offshore use in an arctic environment. The structure incorporating the load bearing outer skin allows loads applied to a skin plate member in contact with ice formations to be spread through a concrete in-fill thereby permitting the use of lighter structural members due to the interaction between the concrete in-fill and the skin plate members and their underlying stiffeners. The sloping outer shell of the structure allows it to be used in varying water depths, soil and loading conditions. As opposed to a true cone shape, the angles at which the outer shell walls meet serve as an aid in breaking up ice formations.

The load bearing outer skin of the structure of the present invention contains an inner assembly and an outer assembly. Both the inner and outer assemblies include a skin plate member which is stiffened by stiffeners welded to one side of the skin plate member. The stiffeners are located at spaced intervals from each other and are disposed substantially perpendicular to the skin plate member. The inner and outer assembly are placed substantially parallel to each other to form a composite structure having an internal cavity defined by the inner and outer plates. The stiffeners of the inner assembly and the outer assembly are disposed in the cavity at a spaced relation to each other and extend partly into the cavity. A cementitious material substantially fills the cavity thereby completing the load bearing outer skin structure. The stiffeners may be flat steel plates or may have the profile of structural shapes such as angles or T's among others.

The load bearing outer skin of the present invention allows horizontal shearing stress between the skin plates and the in fill cementitious material to be transferred by a bond between the two or through the weld between the skin plate member and the stiffeners in cooperation with the bond between the stiffeners and the infill cementitious matirial.

DESCRIPTION OF THE PREFERRED EMBODIMENT

Figure 1:
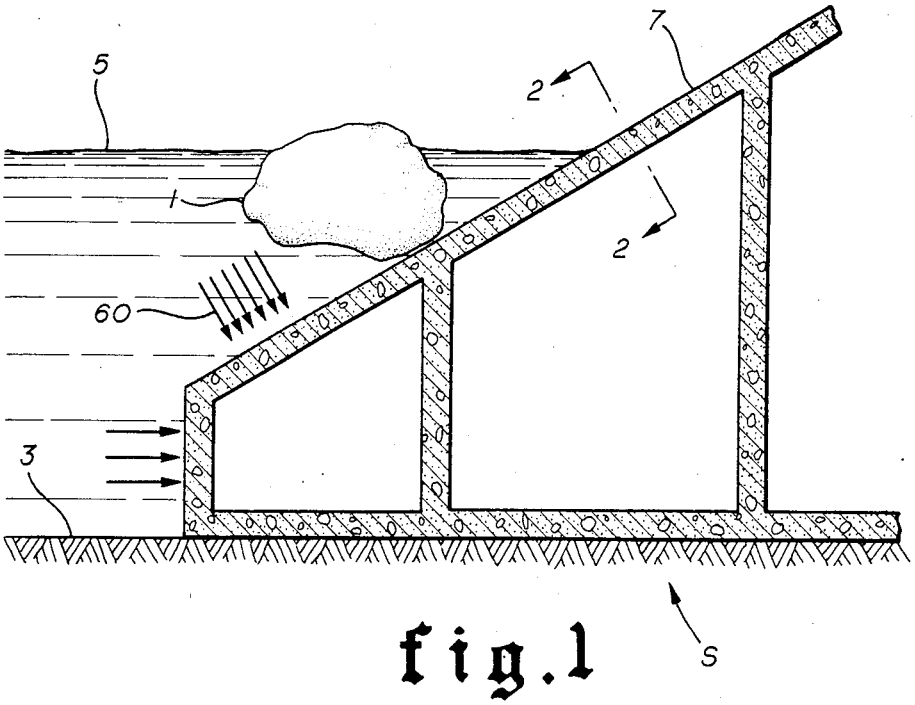
FIG. 1 is a part sectional elevation of a supporting structure located in an offshore arctic environment for supporting the load bearing outer skin of the present invention.

FIG. 1 illustrates marine structure S which includes the load bearing outer skin of the present invention. The structure S is typically designed for installation in arctic and sub-arctic waters upon which ice features 1 may be formed. The entire structure S may be constructed in a less hostile environment, towed to location under its own buoyancy, and installed on location by sea water ballasting. The structure S is held in place on the sea bottom 3 by its own weight plus the weight of any ballast added to the structure (not shown). The structure S extends above the water line 5 and supports the load bearing outer skin 7. The structure S employing load bearing outer skin 7 is suitable for supporting a stable platform 200 (FIG. 9) from which a variety of offshore operations may be performed. These operations include, but are not limited to, exploration drilling, production drilling, hydrocarbon production, gas compression, water flood operations, enhanced hydrocarbon recovery, gas liquifaction, mineral ore extraction and processing, coal handling, storage of materials and equipment, offshore loading of tankers and other vessels, and offshore housing of personnel.

Figure 9:
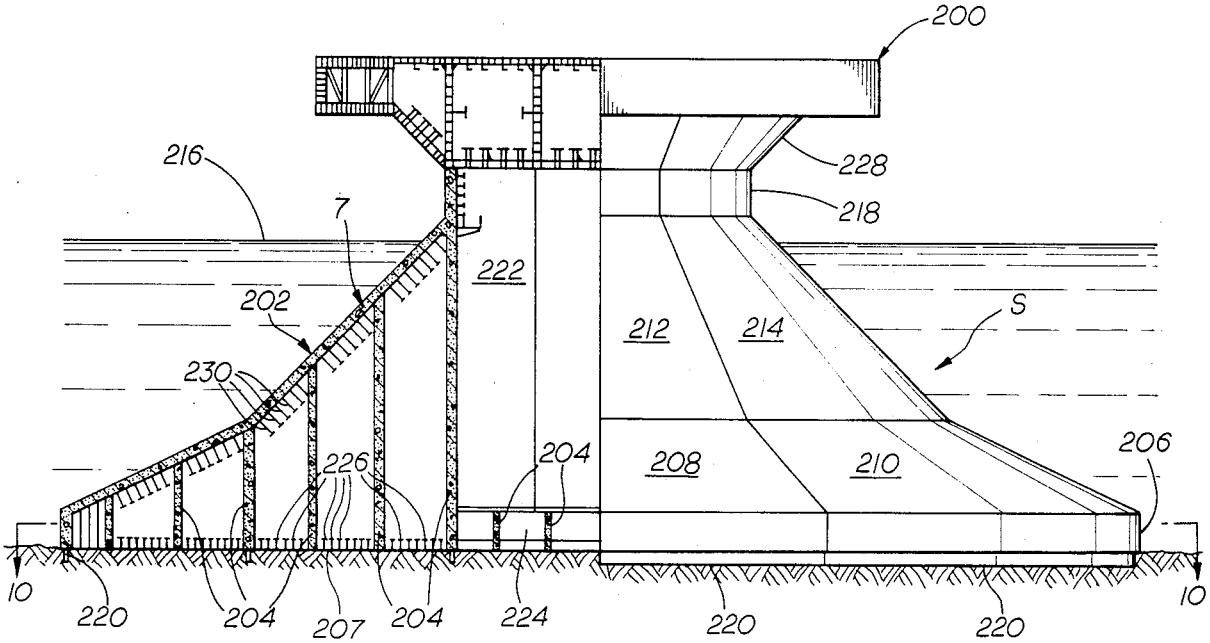
FIG. 9 is a partial sectional elevational view of the structure of the present invention.
Figure 10:
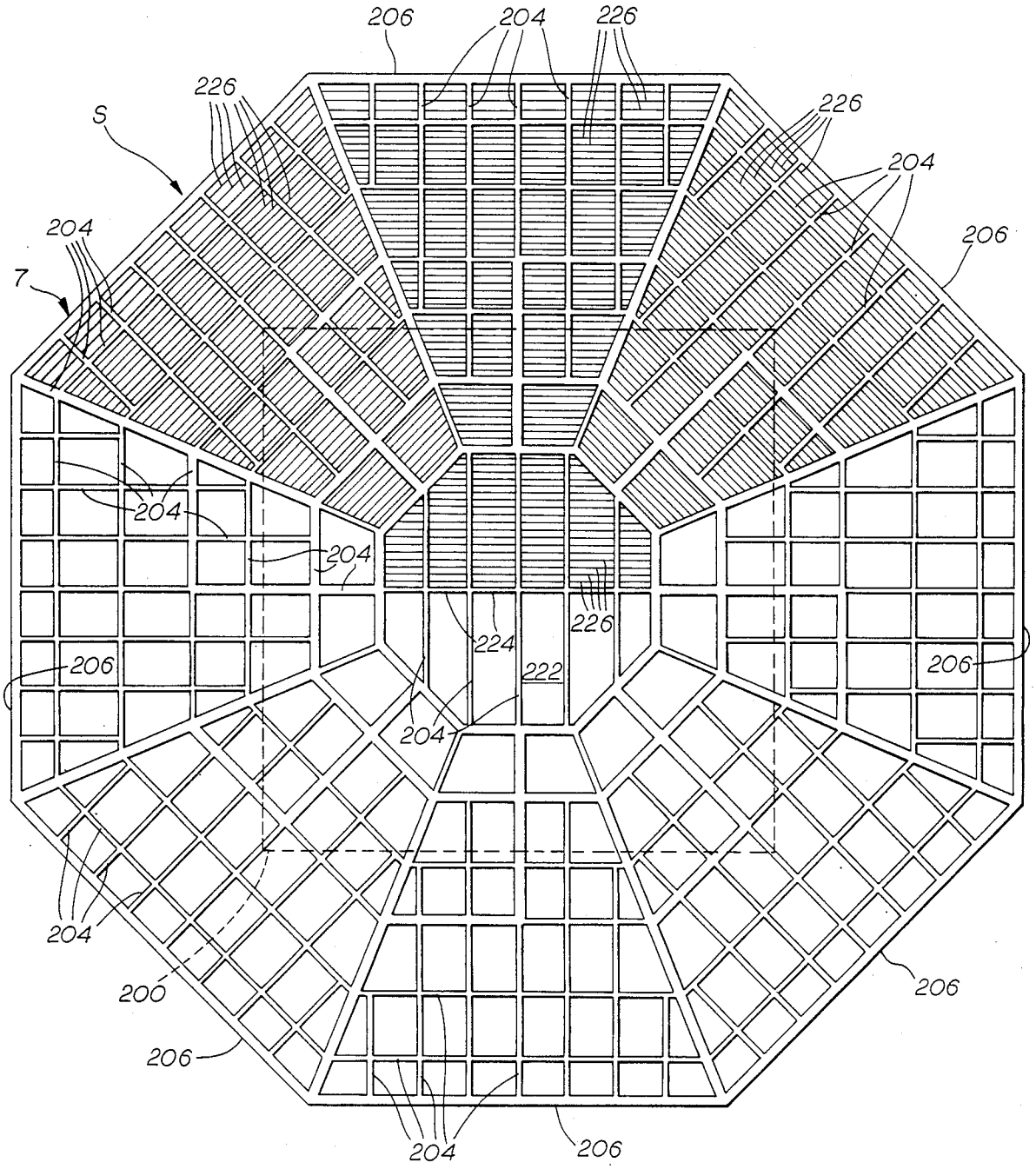
FIG. 10 is a plan view taken along lines 10—10 of FIG. 9.

The structure S as shown in FIGS. 9 and 10 is a relocatable, water ballasted, gravity structure of composite steel-concrete construction. The details of the wall sections which comprise outer shell 202 and bulkhead walls 204 will be discussed in more detail hereinbelow. As seen in FIG. 10, the perimeter of the base 206 defines an octagon. However, polygons containing more or fewer than eight sides may be used without departing from the spirit of the invention. Outer shell 202 is composed of sloped segments such as 208, 210, 212, and 214. As seen in FIG. 9 segments 208 and 210 are adjacent to each other and extend from base 206. Six other sloped segments comparable to segments 208 and 210 extend from base 206 to form a frustum. Depending upon the water depth, soil conditions and loads imposed on the structure S, additional sloped segments such as 212 and 214 may be placed on top of sloped segments 208 and 210 respectively. The angle formed between sloped seqments 212 and 214 and base 206 may be the same or different from the angle formed between segments 208 and 210 with the base. Whether only segments such as 208 and 210 are used or segments such as 212 and 214 are added, the structure is desiqned such that the maximum water line 216 does not rise to vertical neck section 218. Base 206 further includes steel skirts 220 on its underside. Skirts 220 are made of corrugated steel and are designed to penetrate the seabed soil. The space between the seabed and the underside of the base is grouted with sand (not shown) to provide a uniform bearing so that vertical ice load components can be effectively transferred to the seabed through the structure.

As shown in FIG. 10, bulkheads 204 are arranged in a circumferential and radial pattern to support outer shell 202. The central section of structure S is an enlarged opening or moon pool 222. Drilling and other related activities from platform 200 are carried on through moon pool 222 and openings 224 in base 206. It should be noted that for structural rigidity, base 206 is not completely devoid of reinforcement in the moon pool 222. As seen in FIGS. 9 and 10, composite wall sections 204, as will be described in more detail hereinbelow extend across openings 224 in moon pool 222. Base 206 is formed of steel plates 207 supported by circumferential plate girders 226 spanning between the radial bulkhead walls. Base 206 does not employ the composite wall structure of the present invention except around moon pool 222.

Platform 200 may be a two level structure which is formed of ship type construction formed to be square, rectangular, octagonal or other shape in plan. Platform 200 is supported by an octagonal to square transition 228 which sits atop vertical neck section 218. Transition 228 not only serves to support platform 200 but provides a reverse slope on the outer periphery of the structure S which deflects the ice features which climb up the outer shell 202 of structure S. Furthermore, the sharp angle formed between slope segment 212 to slope segment 214 due to the octagonal shape of base 206 further helps to break up ice features which come in contact with outer shell 202.

Outer shell 202 is further supported by circumferential plate girders 230 spanning over the radial bulkhead walls 204. Plate girders 230 are individual steel members and are not infilled with a cemetitious material. An internal bulkhead system formed by radial and circumferential bulkheads 204 subdivides the plan area of the structure S into trapezoidal cells and provides global resistance to concentrated ice flows applied to the outer shell 202. Bulkhead walls 204 are constructed in the same fashion as outer shell 202 as will be more fully described hereinbelow. Bulkhead walls 204 are generally of full height between the base 206 and outer shell 202, except those bulkhead walls 204 in the moon pool 222 which are of sufficient height to lend structural rigidity to the base 206.

The structure of the present invention employing a polygonal base and sloping side walls forming a frustrum presents an economical design which can be fabricated in segments without the need to curve any of the outer shell plates. The use of the polygonal base permits economical construction of the structure S and further provides additional ice breaking capability due to the angular transitions between sloped segments such as 212 and 214. The reverse slope provided by transition 228 in combination with segments such as 212 and 214 enhances the ice breaking and deflecting characteristics of structure S. The shape of structure S combined with the composite wall construction, as described hereinbelow provides an efficient method of construction of a lightweight structure which can be quickly towed to the site and rapidly set up for use.

Figure 3:
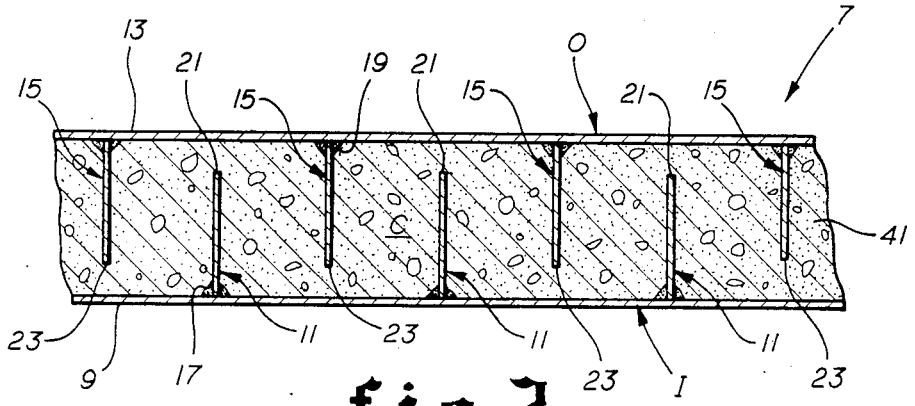
FIG. 3 is a section of the load bearing outer skin taken along lines 3—3 of FIG. 2.

Referring to FIG. 3, load bearing outer skin 7 includes an inner assembly I and an outer assembly O. Inner assembly I contains a skin plate member 9 made of steel or other suitable high strength material compatible with the marine environment. A series of elongate, planar stiffeners 11 are continuously welded to skin plate member 9 and project substantially perpendicularly therefrom. In the preferred embodiment, stiffeners 11 are disposed parallel to each other at spaced equal intervals, although unequal spacing may be used without departing from the spirit of the invention.

The outer assembly O includes skin plate member 13 which is of similar construction as skin plate member 9. Skin plate member 13 is stiffened via stiffeners 15 which are disposed in a plane perpendicular to skin plate member 13. Stiffeners 15 are disposed at spaced intervals parallel to each other although a spacing employing unequal intervals is within the scope of the invention.

To form the load bearing outer skin 7 of the present invention, inner assembly I and outer assembly O are aligned substantially parallel to each other to form a cavity C therebetween. In the preferred embodiment (FIG. 3) stiffeners 11 and stiffeners 15 extend only partly into cavity C. Stiffeners 11 extend into cavity C without reaching skin plate member 13, and stiffeners 15 span a portion of cavity C without coming in contact with skin plate members 9. The projection of stiffeners 11 and 15 into cavity C is a design element determined by the requirements of each application. Accordingly, stiffeners 11 and 15 may extend less than halfway across cavity C or substantially across the entire cavity C as shown in FIG. 3.

Figure 2:
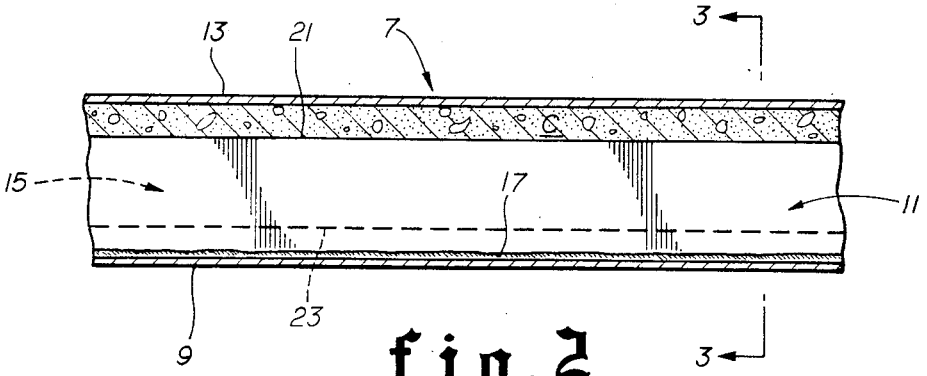
FIG. 2 taken along lines 2—2 of FIG. 1.

As seen in FIG. 3, inner assembly I is positioned adjacent outer assembly O so that stiffeners 11 project alternatively with stiffeners 15 into cavity C. Although FIG. 3 displays a pattern of one stiffener 15 disposed between two stiffeners 11 and vice versa, other alternating staggering patterns between stiffeners 11 and stiffeners 15 can be employed without departing from the spirit of the invention. As shown in FIGS. 2 and 3, stiffeners 11 and 15 are elongated flat plates. Stiffeners 11 have an elongated longitudinal edge 17 which is continuously welded to skin plate members 9. Similarly, stiffeners 15 have an elongated longitudinal edqe 19 continuously welded to skin plate members 13. Stiffeners 11 and 15 have longitudinal free ends 21 and 23 respectively which project into cavity C.

Figure 4:
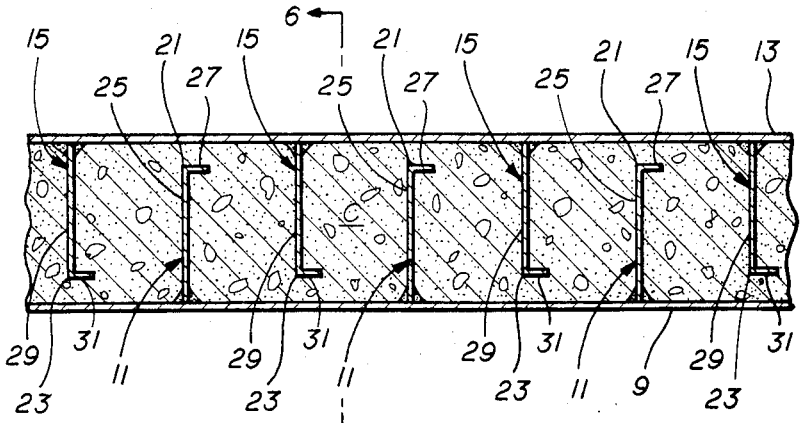
FIG. 4 shows an alternate embodiment of the load bearing outer skin employing L-shaped stiffeners.
Figure 5:
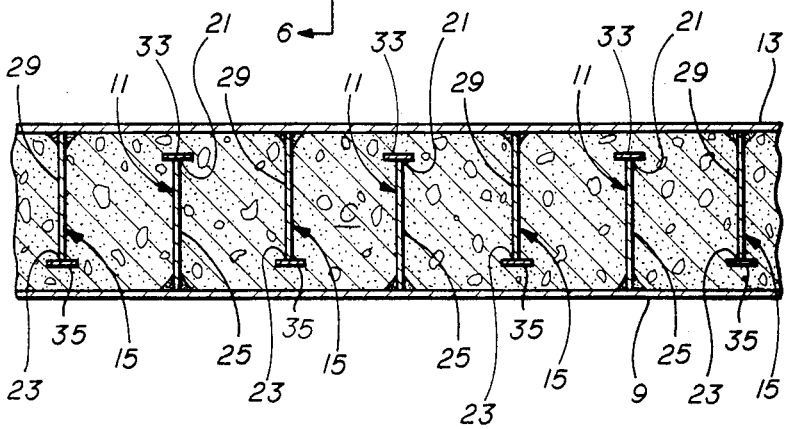
FIG. 5 is an alternate embodiment of the load bearing outer skin shown in FIG. 3.

Alternatively (FIGS. 4 and 5) stiffeners 11 and 15 may be found in L or a T-shape. As seen in FIG. 4 L-shaped stiffeners 11, may be formed having an elongated flat plate section 25 and a flat anchor segment 27 formed perpendicularly to plate section 25 at free end 21. Similarly, T-shaped stiffeners 15 are formed of an elongated flat plate section 29 and a flat anchor segment 31 disposed perpendicularly to elongated flat plate section 29. Anchor segment 31 is mounted to free end 23 of elongated flat plate section 29. It should be noted that flat anchor segments 27 or 31 may be separate pieces welded or otherwise connected to elongated flat plate sections 25 and 29 respectively, or stiffeners 11 and 15 may be integral pieces formed to have the L-shape displayed in FIG. 4 by bending such stiffeners adjacent their free ends 21 or 23.

Stiffeners 11 and 15 may also be formed to have a T-shape (FIG. 5) by attaching flat segments 33 and 35 to free ends 21 and 23 of stiffeners 11 and 15, respectively. Flat segments 33 and 35 are disposed in cavity C substantially parallel to each other and substantially perpendicular to both elongated flat plate sections 25 and 29 of stiffeners 11 and 15, respectively. Although flat, L-shaped, and T-shaped configurations for stiffeners 11 and 15 have been described, elongated stiffeners, other cross-sections are within the purview of the present invention.

Figure 6:
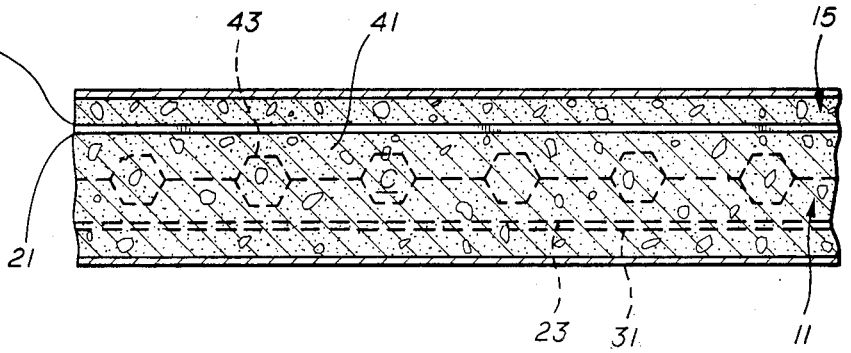
FIG. 6 is a section through the load bearing outer skin taken along lines 6—6 of FIG. 4.

With outer assembly O positioned substantially parallel to the inner assembly I as described above, a cementitious material 41 is poured between skin plate members 9 and 13 to complete the load bearing outer skin 7 of the present invention. To facilitate distribution of the cementitious material 41, to reduce the overall weight of the load bearing outer skin 7 of the present invention, and to improve bonding, stiffeners 11 and/or 15 may have a plurality of openings 43 formed therein as shown in FIG. 6. It is understood that although FIG. 6 illustrates openings 43 formed in an L-shaped stiffener 11 of FIG. 4, such openings may be used in flat plate stiffeners 11 and 15 shown in FIG. 1 as well as alternative embodiments (such as FIGS. 4 and 5) employing L-shaped or T-shaped stiffeners. Openings 43 may be formed by removing material from a unitary elonqated flat plate section 29 or, as shown in FIG. 6 elongated flat plate section 29 may be formed from two pieces each of which having had material removed from its edge.

Figure 7:
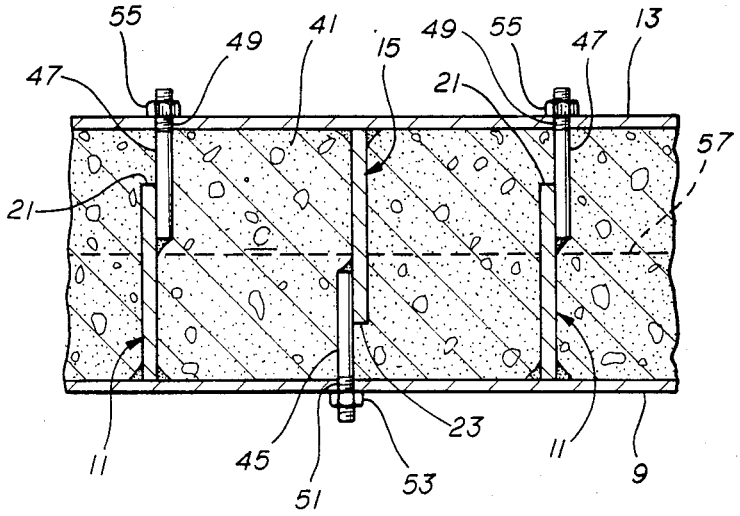
FIG. 7 is a sectional view of the load bearing outer skin.

Referring to FIG. 7, inner assembly I and outer assembly O is held in place while cementitious material 41 is poured therebetween via a plurality of connecting members 45 and 47. A corresponding plurality of holes 49 and 51 are cut in skin plate members 9 and 13, respectively. Connecting members 45 which can be threaded rods, long bolts, or other suitable fastening devices, are welded to stiffeners 15 adjacent their free end 23. As an alternative to connecting members 45 or in addition thereto, connecting members 47 are welded to stiffeners 11 adjacent their free ends 21. Connecting members 45 extend beyond free end 23 through holes 51 in skin plate members 13. Similarly, connecting members 47 extend beyond the free ends 21 of stiffeners 11 and through holes 49 of skin plate members 9. Nuts 53 and 55 are threaded onto connecting members 45 and 47, respectively. The assembly of nuts 53 and 55 and connecting members 45 and 47 resist the tendency of inner assembly I and outer assembly O to separate when cementitious material 41 is poured therebetween. After the cementitious material 41 has been poured and at least partially hardened, nuts 53 and 55 and the protruding portions of connecting members 45 and 47 may be cut off. Thereafter holes 49 and 51 are patched so that skin plate members 13 provide a continuous surface for application of any coatings, as desired. It is understood that the details of each application determine the quantity and location of connecting members 45 and 47. Similarly, only connecting members 45 or alternatively only connecting members 47 or both may be used to retain the relative positions of inner assembly I and outer assembly O during the pouring of the cementitious material 41.

Figure 8:
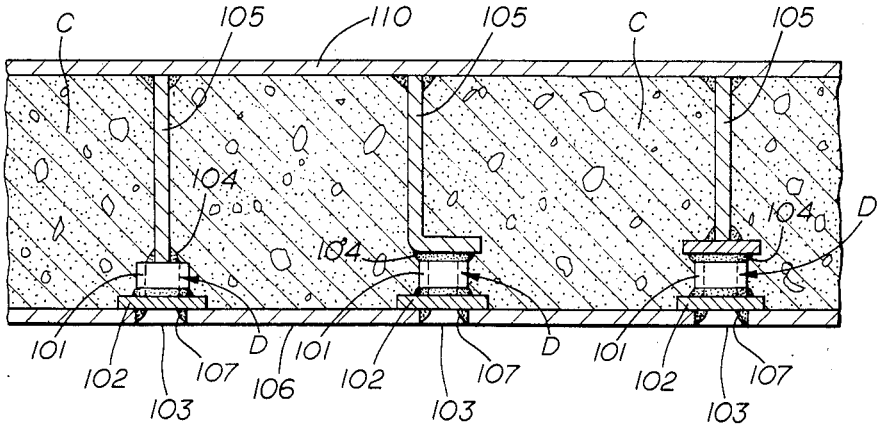
FIG. 8 is a sectional view of the load bearing outer skin showing an alternative embodiment of the connecting members.

Referring to FIG. 8 the inner assembly I and the outer assembly O can also be held in place while cementitious material 41 is poured therebetween via a plurality of connecting members D. A plurality of openings 103 are formed in a skin plate member 106. Connecting member D includes short pipe sections 101 which are welded to a square or rectangular plate 102. These pipe-plate assemblies are then welded at junction 104 to the extremities of stiffeners 105 at appropriate intervals to correspond to openings 103. When skin plate member 110 is aligned with skin plate member 106, plates 102 are aligned and adjacent to openings 103 within cavity C. Thereafter, plates 102 may be conveniently welded from outside cavity C to skin plate member 106 at junction 107 within opening 103. Thereafter, the weld material 107 can be ground flush with the surface of skin plate member 106, if desired, prior to application of any desired coating. Alternatively, if the composite wall construction is used for a surface that does not need to be coated such as an interior bulkhead, no cutting away is required after the cemetitious material has hardened. It is understood that the details of each application determine the quantity and location of connecting members D. Similarly, connecting members D may be used on stiffeners 105 as shown in FIG. 8 and on stiffeners connected to the opposing skin plate member 106 (not shown).

Once the cementitious material 41 has hardened the load bearing outer skin 7 will function as an efficient structural system. The horizontal shearing stress distribution between skin plate member 9 and skin plate member 13 and the cementitious material 41 can be transferred in one of two ways. The shearing stress may be transferred by the bond between the cementitious material 41 and the skin plate members 9 and 13 or through the welds between the skin plate members 9 and 13 to stiffeners 11 and 15, respectively, thereby relying on the bond between stiffeners 11 and 15 and the cementitious material. A similar system of horizontal shear stress transfer exists in the orthogonal direction also enabling the assembly to function as a two-way system.

Due to this interaction between the cementitious material 41 and the inner assembly I and outer assembly O, the load bearing outer skin 7 can provide adequate strength while using concrete of a lesser strength than that required in conventional prestressed concrete construction. Furthermore, placing of the cementitious material is much simpler due to the absence of complex reinforcing arrangements required in traditional prestressed concrete construction for load bearing outer skins of arctic offshore structures.

Due to the support provided by the cementitious material 41 to the skin plate member 13 coming in contact with the ice features 1, thinner steel or other equivalent high strength material can be used. Similarly, stiffeners 11 and 15 may also be thinner than conventional steel construction due to the restraint against buckling provided by the cementitious material 41 which completely surrounds stiffeners 11 and 15. Importantly, local loads applied to the outer surface of skin plate member 13 by ice features 1 (which are typically in a normal direction as shown by arrows 60 in FIG. 1) are spread throuqh the cementitious material 41 within cavity C to reduce loads on support members of structure S which results in a reduction of overall costs. Furthermore, since skin plate members 9 and 13 are plaoed at the furthest possible distanoe from the neutral axis 57 (see FIG. 7), a smaller steel area is required when compared to conventional reinforced concrete construction.

The load bearing outer skin 7 of the present invention provides many construction economies. Skin plate members 9 and 13 act as a formwork for the cementitious material 41 thereby eliminating a substantial cost item as compared to using a concrete load bearing outer skin. Inner assembly I and outer assembly O may be easily constructed in a fabrication shop in a relatively open environment as opposed to load bearing outer skins employing steel construction wherein stiffeners must be continuously welded to an inner and an outer steel plate in a confined space. For the same reasons, inspection and rectification of faulty welds is considerably simpler.

The composite structure of the load bearing outer skin 7 of the present invention further enables the structure S to absorb accidental impact from multi-year ice features 1 without distorting skin plate member 13 or stiffeners 15 attached thereto. Finally, ice bond reducing coatings, may be confidently applied to the steel skin plate member 13 since such coatings have a known efficacy when applied to steel surfaces. The efficacy of such coatings on concrete surfaces is yet unproven.

The foregoing disclosure and description of the invention are illustrative and explanatory thereof, and various changes in the size, shape and materials, as well as in the details of the illustrated construction may be made without departing from the spirit of the invention.

We claim:

1. An arctic offshore structure comprising:

a polygonal shaped base;

a sloping outer shell connected to said base forming a frustrum with said base;

bulkhead walls substantially vertical to said base and extending from said base to said sloping outer shell for support thereof;

said sloping outer shell and said bulkhead walls further comprising:

an inner assembly;

an outer assembly aligned substantially parallel to said inner assembly and defining an internal cavity therebetween;

said inner and outer assemblies each comprising:

a skin plate member;

a plurality of stiffeners attached at spaced intervals to said skin plate member and mounted substantially perpendicular to said skin plate member so as to extend partially into the internal cavity; and a cementitious material substantially filling the internal cavity.

2. The structure of claim 1 wherein:

each of said stiffeners is an elongated flat plate having a first longitudinal edge attached to said skin plate member and a second longitudinal edge extending into said cavity.

3. The structure of claim 2, wherein:

said stiffeners are formed having a plurality of openings formed therein to facilitate the flow of said cementitious material therethrough, and increase the bond strength between said cementitious material and said stiffeners.

4. The structure of claim 2 wherein each of said stiffeners further includes:

a flat anchor segment, said flat anchor segment connected to said second longitudinal edge of said stiffener and disposed substantially perpendicular to said elongated flat plate and substantially parallel to said skin plate member thereby giving said stiffener an L-shape when viewed along its longitudinal axis.

5. The structure of claim 2 wherein:

each of said stiffeners has a flat anchor segment adjacent its second longitudinal edge, said flat anchor segment being integral with said stiffener and disposed in a plane parallel to said skin plate member thereby giving said stiffener an L-shape when viewed along its longitudinal axis.

6. The structure of claim 4 wherein:

said stiffeners are formed having a plurality of openings formed therein to facilitate the flow of a cementitious material through said stiffeners and increase the bond strength between said cementitious material and said stiffeners.

7. The structure of claim 5 wherein:

said stiffeners are formed having a plurality of openings formed therein to facilitate the flow of a cementitious material through said stiffeners and increase the bond strength between said cementitious material and said stiffeners.

8. The structure of claim 2 wherein each of said stiffeners includes:

a flat segment, said flat segment connected to said second longitudinal end of said stiffener and disposed substantially perpendicular to said elongated flat plate and substantially parallel to said skin plate member thereby giving said stiffener a T-shape when viewed along its longitudinal axis.

9. The structure of claim 8 wherein:

each of said stiffeners are formed having a plurality of openings formed therein to facilitate the flow of a cementitious material therethrough and increase the bond strength between said cementitious material and said stiffeners.

10. The structure of claim 1 wherein:

said skin plate member is formed having a plurality of openings;

a plurality of elongate connecting members, each having a cross-section conforming to the shape of one of said openings, and connected to said stiffeners and spanning said cavity and extending through one of said openings in an opposing skin plate member; and securing means attached to the end of said elongate oonneoting members extending throuqh said openings for maintaining the relative positions of said skin plate members to each other until said cementitious material has been poured and hardened.

11. A load bearing outer skin for an arctic offshore structure comprising:

an inner assembly;

an outer assembly aligned substantially parallel to said inner assembly and defining an internal cavity therebetween;

said inner and outer assemblies each comprising:

a skin plate member having a plurality of openings formed therein;

a plurality of stiffeners attached at spaced intervals to said skin plate member and mounted substantially perpendicular to said skin plate member so as to extend partially into the internal cavity;

a cementitious material substantially filling the internal cavity;

a plurality of elongate connecting members for attachement between said stiffeneres and said skin plate members, said connnecting members each having a first end and a second end, said first end having a cross-sectional area than the openings formed in said skin plate member, said second end of said connecting members being attached to said stiffeners, said connecting members, said stiffeners and said other plate members being formed such that when said skin plate members of said inner and outer assemblies are aligned, each combination of said connecting members and said stiffeners to which said connecting members are attached span said cavity and said first ends of said connecting members are positioned adjacent said openings in said skin plate mmebers;

means for securing said first ends of said connecting members to said skin plate member via the openings formed therein.

12. The load bearing outer skin of claim 11 wherein said connecting members comprise:

a tubular segment;

a flat plate connected to one end of said tubular segment.

13. An arctic offshore structure comprising:

a polygonal shaped base;

a sloping outer shell connected to said base forming a frustrum with said base;

bulkhead walls substantially vertical to said base and extending from said base to said sloping outer shell for support thereof;

said sloping outer shell and said bulkhead walls comprising:

an inner assembly;

an outer assembly aligned substantially parallel to said inner assembly and defining an internal cavity therebetween;

said inner and outer assemblies each comprising:

a skin plate member;

a plurality of stiffeners having a first end and a second end, said first end of said stiffeners being attached at spaced intervals to said skin plate member and mounted substantially perpendicularly to said skin plate member, said second end of said stiffeners being unattached and extending partially into the internal cavity;

a cementitious material substantially filling the internal cavity.

wherein said inner assembly, said outer assembly and said cementitious material form a composite flexural member for resisting applied loads.

14. The structure of claim 13 wherein:

each of said stiffeners is an elongated flat plate having a first longitudinal edge attached to said skin plate member and a second longitudinal edge extending into said cavity.

15. The structure of claim 14, wherein:

said stiffeners have a plurality of openings formed therein to facilitate the flow of said cementitious material therethrough, and increase the bond strength between said cementitious material and said stiffeners.

16. The structure of claim 14 wherein each of said stiffeners further includes:

a flat anchor segment, said flat anchor segment connected to said second longitudinal edge of said stiffener and disposed substantially perpendicular to said elongated flat plate and substantially parallel to said skin plate member thereby giving said stiffener an L-shape when viewed along its longitudinal axis.

17. The structure of claim 14 wherein:

each of said stiffeners has a flat anchor segment adjacent its second longitudinal edge, said flat anchor segment being integral with said stiffener and disposed in a plane parallel to said skin plate member thereby giving said stiffener an L-shape when viewed along its longitudinal axis.

18. The structure of claim 16 wherein:

said stiffeners are formed having a plurality of openings formed therein to facilitate the flow of a cementitious material through said stiffeners and increase the bond strength between said cementitious material and said stiffeners.

19. The structure of claim 17 wherein:

each of said stiffeners has a flat anchor segment adjacent its second longitudinal edge, said flat anchor segment being integral with said stiffener and disposed in a plane parallel to said skin plate member thereby giving said stiffener an L-shape when viewed along its longitudinal axis.

20. The structure of claim 15 wherein each of said stiffeners includes:

a flat segment, said flat segment connected to said second longitudinal end of said stiffener and disposed substantially perpendicular to said elongated flat plate and substantially parallel to said skin plate member thereby giving said stiffener a T-shape when viewed along its longitudinal axis.

21. The structure of claim 20 wherein:

each of said stiffeners are formed having a plurality of openings formed therein to facilitate the flow of a cementitious material therethrough and increase the bond strength between said cementitious material and said stiffeners.

22. The structure of claim 14 wherein:

said skin plate member is formed having a plurality of openings;

a plurality of elongate connecting members, each having a cross-section conforming to the shape of one of said openings, and connected to said stiffeners and spanning said cavity and extending through one of said openings in an opposing skin plate member; and securing means attached to the end of said elongate connecting members extending through said openings for retaining said skin plate members to each other until said cementitious material has been poured and set up in said cavity whereupon said securing means may be removed.

23. The structure of claim 13 wherein:

said skin plate members are formed having a plurality of openings;

a plurality of elongate connecting members each having a substantially planar end, said end having an area larger than each of said openings, said connecting members attached to said stiffeners, whereupon when said skin plate members of said inner and outer assemblies are aligned each combination of said connecting members and said stiffeners to which said connecting members are attached span said cavity and said substantially planar ends are adjacent said openings in said skin plate members;

means for securing each said substantially planar end to the skin plate member adjacent thereto from outside said cavity.

24. The structure of claim 1 wherein:

said skin plate members are formed having a plurality of openings;

a plurality of elongate connecting members each having a substantially planar end, said end having an area larger than each of said openings, said connecting members attached to said stiffeners, whereupon when said skin plate members of said inner and outer assemblies are aligned each combination of said connecting members and said stiffeners to which said connecting members are attached span said cavity and said said substantially planar ends are adjacent said openings in said skin plate members;

means for securing each said substantially planar end to the skin plate member adjacent thereto from outside said cavity.

25. The structure of claim 1 wherein said outer shell further includes:

a reverse slope adjacent its upper end.

26. The structure of claim 25 wherein said outer shell further includes a transition section substantially perpendicular to said base between said sloping segment and said reverse slope.

27. The structure of claim 13 wherein said outer shell further includes:

a reverse slope adjacent its upper end.

28. The structure of claim 27 wherein said outer shell further includes a transition section substantially perpendicular to said base between said sloping segment and said reverse slope.

29. A method of assembly of a load bearing outer skin for an arctic offshore structure comprising the steps of:

fabricating an inner assembly;

fabricating an outer assembly;

said inner and outer assemblies each comprising:

a skin plate member; and a plurality of stiffeners attached at spaced intervals to said skin plate member and mounted substantially perpendicular to said skin plate member;

aligning said outer assembly substantially parallel to said inner assembly thereby forming a cavity, said stiffeners being disposed in said cavity at spaced intervals from each other and extending partially into said cavity;

cutting holes into at least one of said skin plate members;

fastening a first end of connecting members adjacent a free longitudinal end of at least one of said stiffeners, each combination of said connecting members and said sitffeners to which they are attached spanning said cavity and said connecting members having a substantially planar second end opposite said first end;

securing each said substantially planr second end to an opposing skin plate member adjacent said holes in said opposing skin plate member;

substantially filling said cavity with a cementitious material.

* * * * *

UNITED STATES PATENT AND TRADEMARK OFFICE

CERTIFICATE OF CORRECTION

PATENT NO. : 4,655,642

DATED : April 7, 1987

INVENTOR(S) : Jal N. Birdy, Brian J. Watt and Jade Chen

It is certified that error appears in the above-identified patent and that said Letters Patent is hereby corrected as shown below:

At column 2, line 55, change "ooncrete" to --concrete--.

At column 3, line 35, change "matirial" to --material--.

At column 3, line 42, please insert --is a section-- between the words "Fig. 2" and "taken".

At column 5, line 13, change "cemetitious" to --cementitious--.

At column 6, line 62, change "elonqated" to --elongated--.

At column 7, line 51, change "cemetitious" to --cementitious--.

At column 8, line 30, change "plaoed" to --placed--.

At column 8, line 30, change "distanoe" to --distance--.

At column 10, line 10, change "oonneoting" to --connecting--.

At column 10, lines 29-30, change "at-tachement" to --at-tachment--.

At column 10, line 45, change "mmembers" to --members--.

At column 12, line 43, change "said said" to --said--.

At column 14, line 2, change "sitffeners" to --stiffeners--.

At column 14, line 6, change "planr" to --planar--.

Signed and Sealed this

Eighth Day of September, 1987

*Attest:*

*Attesting Officer*

DONALD J. QUIGG

*Commissioner of Patents and Trademarks*